US012774019B2

(12) United States Patent
Woo et al.

(10) Patent No.: US 12,774,019 B2
(45) Date of Patent: Oct. 27, 2026

(54) VEHICLE CONTROL SYSTEM AND METHOD

(71) Applicant: Transportation IP Holdings, LLC, Norwalk, CT (US)

(72) Inventors: Derek K. Woo, Melbourne, FL (US); James D. Brooks, Schenectady, NY (US); Manthram Sivasubramaniam, Bengaluru (IN); Sanketh Bhat, Bengarulu (IN); Sahil Modi, Bengarulu (IN); Jayeshkumar Jayanarayan Barve, Bengaluru (IN)

(73) Assignee: Transportation IP Holdings, LLC, Norwalk, CT (US)

( * ) Notice: Subject to any disclaimer, the term of this patent is extended or adjusted under 35 U.S.C. 154(b) by 890 days.

(21) Appl. No.: 17/389,097

(22) Filed: Jul. 29, 2021

(65) Prior Publication Data

US 2023/0030781 A1 Feb. 2, 2023

(51) Int. Cl.

| | |
|---|---|
| ***B61L 27/02*** | (2006.01) |
| ***B61C 17/00*** | (2006.01) |
| ***B61L 27/70*** | (2022.01) |

(52) U.S. Cl.

CPC ..... *B61L 27/02* (2013.01); *B61C 17/00* (2013.01); *B61L 27/70* (2022.01)

(58) Field of Classification Search

CPC ..... B61L 27/02; B61L 27/70; B61L 3/127; B61L 15/0027; B61C 17/00; B61C 17/12

See application file for complete search history.

(56) References Cited

U.S. PATENT DOCUMENTS

| | | | |
|---|---|---|---|
| 3,639,755 | A | 2/1972 | Wrege |
| 3,655,962 | A | 4/1972 | Koch |
| 4,005,837 | A | 2/1977 | Grundy |
| 4,005,838 | A | 2/1977 | Grundy |
| 4,190,220 | A | 2/1980 | Hahn |
| 4,208,717 | A | 6/1980 | Rush |

(Continued)

FOREIGN PATENT DOCUMENTS

JP 3431430 B2 7/2003

OTHER PUBLICATIONS

English Translation of Japanese Patent No. 3431430 published Jul. 28, 2003 (18 pages).

*Primary Examiner* — Thomas E Worden
*Assistant Examiner* — Elizabeth Rose Neleski
(74) *Attorney, Agent, or Firm* — K&L Gates LLP

(57) ABSTRACT

A vehicle control system an onboard controller device to interface with a propulsion system and a brake system. A remote controller device wirelessly communicates with the onboard controller device and receives input from an operator, generates control signals based on the input, wirelessly communicates the control signals to the onboard controller device while the vehicle system moves along one or more main line routes. A method includes receiving input from an operator at a remote controller device, generating control signals at the remote controller device based on the input from the operator, wirelessly communicating the control signals to an onboard controller device, controlling one or more of a propulsion system or a brake system of the vehicle system to change movement of the vehicle system while the vehicle system moves along one or more main line routes.

15 Claims, 5 Drawing Sheets

(56) References Cited

U.S. PATENT DOCUMENTS 4,209,828 A 6/1980 Anderson
4,217,643 A 8/1980 Anderson
4,270,716 A 6/1981 Anderson
4,410,154 A 10/1983 Matty
4,556,941 A 12/1985 Zuber
4,562,543 A 12/1985 Zuber
4,566,067 A 1/1986 Sahasrabudhe
4,578,754 A 3/1986 Sahasrabudhe
4,617,627 A 10/1986 Yasunobu
4,687,258 A 8/1987 Astley
5,366,039 A 11/1994 Sawada
5,511,749 A * 4/1996 Horst ..... B61L 17/00 104/295
5,570,284 A 10/1996 Roselli
5,685,507 A 11/1997 Horst
5,713,428 A 2/1998 Linden
5,950,967 A * 9/1999 Montgomery ..... B61L 25/025 701/19
6,243,640 B1 6/2001 Beever
6,314,345 B1 11/2001 Coombes
6,353,780 B1 3/2002 Hart
6,449,536 B1 9/2002 Brousseau
6,466,847 B1 10/2002 Horst
6,470,245 B1 10/2002 Proulx
6,658,331 B2 12/2003 Horst
6,799,098 B2 9/2004 Horst
6,814,414 B1 11/2004 Schmitt
6,853,890 B1 2/2005 Horst
6,853,900 B2 2/2005 Rapp
6,937,925 B2 8/2005 Smith
RE39,011 E 3/2006 Horst
7,076,343 B2 7/2006 Komick
7,120,428 B2 10/2006 Higgs
7,121,977 B2 10/2006 Markyvech
7,233,844 B2 6/2007 Peltz
7,679,298 B2 3/2010 Kumar
7,729,818 B2 6/2010 Wheeler et al.
8,030,871 B1 10/2011 Young
8,050,809 B2 11/2011 Geiger
8,280,569 B2 10/2012 Kumar
8,290,645 B2 10/2012 Chandra
8,295,993 B2 10/2012 Kumar
8,509,964 B2 8/2013 Ecton
8,509,971 B1 8/2013 Isailovski
8,738,202 B2 5/2014 Liberatore
8,989,917 B2 3/2015 Kumar
9,120,494 B2 9/2015 Kumar
9,517,772 B1 12/2016 Ngo
9,733,625 B2 8/2017 Kumar
10,640,113 B2 5/2020 Wolff
11,161,486 B2 11/2021 Rice
11,230,306 B2 1/2022 Peltz
11,427,234 B2 8/2022 Hilleary
11,453,421 B2 9/2022 Howard
11,878,725 B2 1/2024 Brooks
2003/0226416 A1 12/2003 Umemoto
2004/0238693 A1 12/2004 Cole
2005/0075764 A1 4/2005 Horst
2005/0205720 A1 9/2005 Peltz
2005/0216143 A1 9/2005 Tolmei
2006/0055347 A1* 3/2006 Pierson ..... A63H 19/24 318/66
2007/0142984 A1 6/2007 Plawecki
2008/0128563 A1 6/2008 Kumar
2008/0300736 A1 12/2008 Tarleton
2009/0099715 A1 4/2009 Cho
2009/0177344 A1* 7/2009 James ..... B61L 27/20 701/19
2009/0248220 A1 10/2009 Ecton
2009/0248223 A1 10/2009 Ecton
2009/0312890 A1 12/2009 Evans
2010/0114407 A1 5/2010 Klooster
2010/0174427 A1 7/2010 Sivasubramaniam
2011/0245998 A1 10/2011 Ecton
2012/0078442 A1 3/2012 Young
2012/0083987 A1 4/2012 Schwindt
2012/0277940 A1 11/2012 Kumar
2012/0303237 A1 11/2012 Kumar
2013/0006443 A1 1/2013 Woo
2013/0018536 A1 1/2013 Cooper
2013/0066490 A1 3/2013 Liberatore
2013/0325258 A1 12/2013 Cooper
2014/0277883 A1 9/2014 Pulliam
2015/0005988 A1 1/2015 Cox
2015/0081150 A1 3/2015 Wolff
2015/0191169 A1 7/2015 Fairgrieve
2015/0291193 A1 10/2015 Perras
2016/0046308 A1 2/2016 Chung
2016/0082987 A1 3/2016 Pulliam
2016/0091320 A1 3/2016 Kapp
2016/0194015 A1 7/2016 Seaton
2016/0297456 A1 10/2016 Nameki
2016/0306360 A1 10/2016 Seaton
2016/0332647 A1 11/2016 Yanai
2016/0362005 A1 12/2016 Donahue
2016/0362123 A1 12/2016 Schultz
2017/0106884 A1 4/2017 Oswald
2017/0106888 A1* 4/2017 Shubs, Jr. ..... B61L 27/57
2017/0308080 A1 10/2017 Brooks
2017/0355388 A1 12/2017 Schultz
2018/0037243 A1 2/2018 Danielson
2018/0065629 A1 3/2018 Wolff
2018/0079410 A1 3/2018 Yamashita
2018/0086208 A1 3/2018 Hodgson
2018/0126987 A1 5/2018 Burford
2018/0170413 A1 6/2018 Wright
2018/0178791 A1 6/2018 Zhu
2018/0215381 A1 8/2018 Owen
2018/0222505 A1 8/2018 Chung
2018/0237011 A1 8/2018 Laurent
2018/0326996 A1 11/2018 Fujisawa
2018/0356814 A1 12/2018 Brooks
2018/0362057 A1 12/2018 Golden
2019/0202484 A1 7/2019 Yamamoto
2019/0255956 A1 8/2019 Okahara
2019/0263432 A1 8/2019 Carlson
2019/0281578 A1 9/2019 Nabetani
2019/0300029 A1 10/2019 Popplewell
2019/0300034 A1 10/2019 Molne
2019/0359237 A1 11/2019 Ouyang
2020/0055532 A1 2/2020 Schultz
2020/0070790 A1 3/2020 Staats
2020/0070860 A1 3/2020 Green
2020/0156604 A1 5/2020 Liu
2020/0223435 A1 7/2020 Wolff
2021/0061324 A1 3/2021 Jovenall
2021/0114458 A1 4/2021 Osaki
2021/0253150 A1 8/2021 Ghaly
2021/0387622 A1 12/2021 Kudo
2022/0017055 A1 1/2022 Rice
2022/0063421 A1 3/2022 Mopagar
2022/0073116 A1 3/2022 Pittman
2022/0126800 A1 4/2022 Schoenly
2022/0185346 A1 6/2022 Oswald
2022/0250667 A1 8/2022 Jovenall
2023/0030781 A1 2/2023 Woo
2023/0035533 A1 2/2023 Woo
2023/0045414 A1 2/2023 Price
2023/0150555 A1 5/2023 Kumar
2023/0271637 A1 8/2023 Kernwein
2023/0331199 A1 10/2023 Woo
2023/0399037 A1 12/2023 Woo et al.
2024/0157809 A1 5/2024 Olson

* cited by examiner

VEHICLE CONTROL SYSTEM AND METHOD

BACKGROUND

Technical Field

The disclosed subject matter described herein relates to systems and methods for control of vehicle systems.

Discussion of Art

Remote control technology is used to enable an operator to remotely control a vehicle system. For example, railway vehicles such as trains may be remotely controlled in a rail yard by a handheld operator control unit (OCU) for scenarios such as set outs, pick-ups, and locomotive movements in the yard. Remote control of rail vehicles in a rail yard can improve crew productivity, reduce car dwell time in the rail yard, reduce manpower for switching operations, and eliminate or reduce the need for a low-horse-power locomotive fleet.

Using remote control technology allows a single operator to conduct local pick-ups and drop-offs between origin and destination and set-out bad order cars. A single operator can bring stranded trains into congested rail yards if the road crews' time expires. Remote control technology also allows a yard-crew member to hostel mainline power around the yard, conduct switching operations, and build the train for departure. Mainline power can be used to build trains and conduct switching operations in the rail yard. Remote control technology can also be used in slow-speed loading and unloading operations, reducing the use of road crews and improving the efficiency of operations.

BRIEF DESCRIPTION

In accordance with one embodiment, a vehicle control system includes an onboard controller device configured to be onboard a vehicle system and that interfaces with a propulsion system and a brake system of the vehicle system to change movement of the vehicle system. The vehicle control system further includes a remote controller device that wirelessly communicates with the onboard controller device. The remote controller device receives input from an operator, generates control signals based on the input, and wirelessly communicates the control signals to the onboard controller device to control the movement of the vehicle system while the vehicle system moves along one or more mainline routes.

In accordance with one embodiment, a method includes receiving input from an operator at a remote controller device of a vehicle control system and generating control signals at the remote controller device based on the input from the operator. The method further includes wirelessly communicating the control signals from the remote controller device to an onboard controller device disposed onboard a vehicle system and controlling one or more of a propulsion system or a brake system of the vehicle system to change movement of the vehicle system using the onboard controller device and based on the control signals that are received from the remote controller device while the vehicle system moves along one or more main line routes.

In accordance with one embodiment, a vehicle control system includes an onboard controller device configured to be onboard a vehicle system and that interfaces with a propulsion system and a brake system of the vehicle system to change movement of the vehicle system. The vehicle control system further includes a remote controller device that wirelessly communicates with the onboard controller device. The remote controller device receives input from an operator, generates control signals based on the input, and wirelessly communicates the control signals to the onboard controller device to control the movement of the vehicle system while the vehicle system moves along one or more main line routes. The control signal directs changes in one or more of dynamic braking or independent brakes of the brake system of the vehicle system.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to systems and methods for remotely operating a vehicle system that includes a plurality of vehicles. The vehicle system may be operated remotely by an operator through a remote controller device. The vehicle system may be operated outside of a facility, such as a rail yard for example in the case of railway vehicles. The vehicle system may be operated at higher speeds and on mainline routes of the vehicle system for activities including setout, pick up, and/or repairs. The speed of the vehicle system may be regulated even if the composition of the vehicle system, the weight of the vehicle system, and/or the grade of the surface that the vehicle system is on are not known or incorrectly determined.

The speed of the vehicle system may be regulated during starting from zero speed. The speed may be regulated even if an operator enters incorrect or no information on the vehicle system weight, the vehicle system composition, or the initial grade. The speed of the vehicle system may be regulated from zero speed (i.e., from starting), during acceleration, and at different speeds, for example up to 40 mph. The speed of the vehicle system may also be regulated, by either accelerating or decelerating, from one target speed to another target speed. The speed of the vehicle system may also be regulated by decelerating to zero speed (i.e., stopping). The speed of the vehicle system may also be regulated to maintain coupler forces between the vehicles within limits.

An open loop control may be used for starting the vehicle system. Open loop control may also be used for regulating the speed of the vehicle system during stopping, for example during coast-to-idle or coast-to-brake modes of operation. Closed loop control may be used to regulate the speed of the vehicle system. The closed loop control may use Proportional-Integral-Derivative (PID) control.

Figure 1:
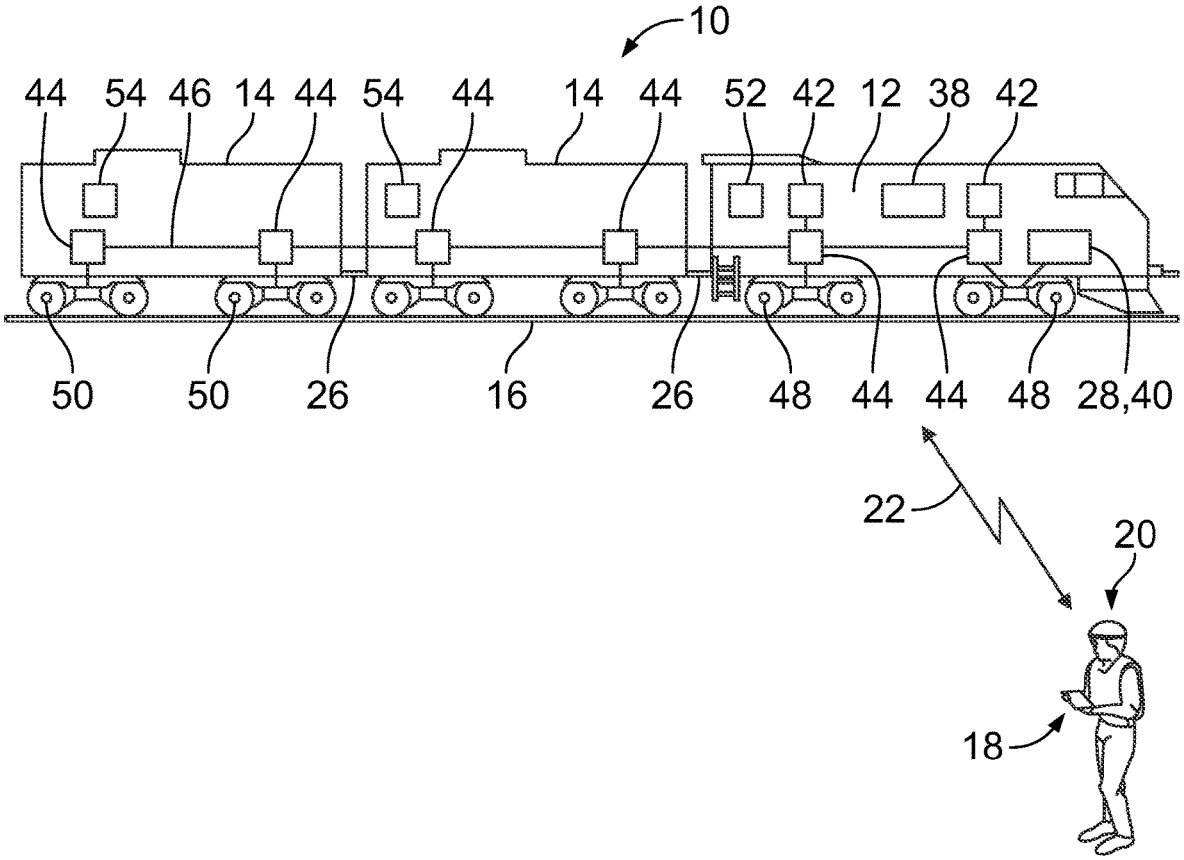
FIG. 1 schematically depicts a system for remotely operating of a vehicle system according to one embodiment.

Referring to FIG. 1, a vehicle system 10 includes a propulsion-generating vehicle 12 and one or more non-propulsion generating vehicles 14 mechanically coupled together by couplers 26 while the vehicle system moves along a route 16. The non-propulsion-generating vehicles may be configured to carry one or more human passengers. According to one embodiment, the route may be in a facility, such as a railyard, or may be a main line route of a rail network for trains. The vehicle system represents a vehicle group. According to one embodiment, the vehicle group may include plural propulsion-generating vehicles (FIG. 2) and non-propulsion-generating vehicles. While the description herein describes a vehicle system being a rail vehicle group having locomotives as the powered vehicles and railcars as the non-powered vehicles (and the vehicle group is a train), alternatively, one or more embodiments described herein may be applied to other types of vehicle groups and/or vehicles. These other vehicle groups may include one or more off-highway vehicles (e.g., mining vehicles or other vehicles that may be not designed or legally permitted for travel on public roadways), marine vessels, automobiles, trucks, aircraft, or the like. Additionally, the vehicle system may be formed from a single vehicle instead of multiple vehicles. Optionally, in a vehicle system formed from several vehicles, the vehicles may be separate from each other but virtually or logically coupled with each other in that the vehicles communicate with each other to coordinate their movements with each other (so that the separate vehicles move together as a larger vehicle system, or convoy, along the routes).

Each propulsion-generating vehicle includes a propulsion system 28. The propulsion system may include on or more traction motors operably coupled with axles and/or wheels of the propulsion-generating vehicles. The traction motors may be connected with the axles and/or wheels via one or more gears, gear sets, or other mechanical devices to transform rotary motion generated by the traction motors into rotation of the axles and/or wheels to propel the vehicles and, consequently, the vehicle system. Different traction motors may be operably connected with different axles and/or wheels such that traction motors that may be deactivated (e.g., turned off) do not rotate corresponding axles and/or wheels while traction motors that remain activated (e.g., turned on) rotate corresponding axles and/or wheels.

The one or more propulsion generating vehicles include an onboard controller device 38. The onboard controller device may include a Proportional-Integral-Derivative (PID) controller. The onboard controller device may include a processor and a memory that stores instructions executable by the processor. The memory may also store data, including data received during operation of the vehicle system, for example while operated by remote control. The onboard controller device may also include a display to display information to an operator of the vehicle system and an input device, such as a touch screen or keyboard.

Figure 2:
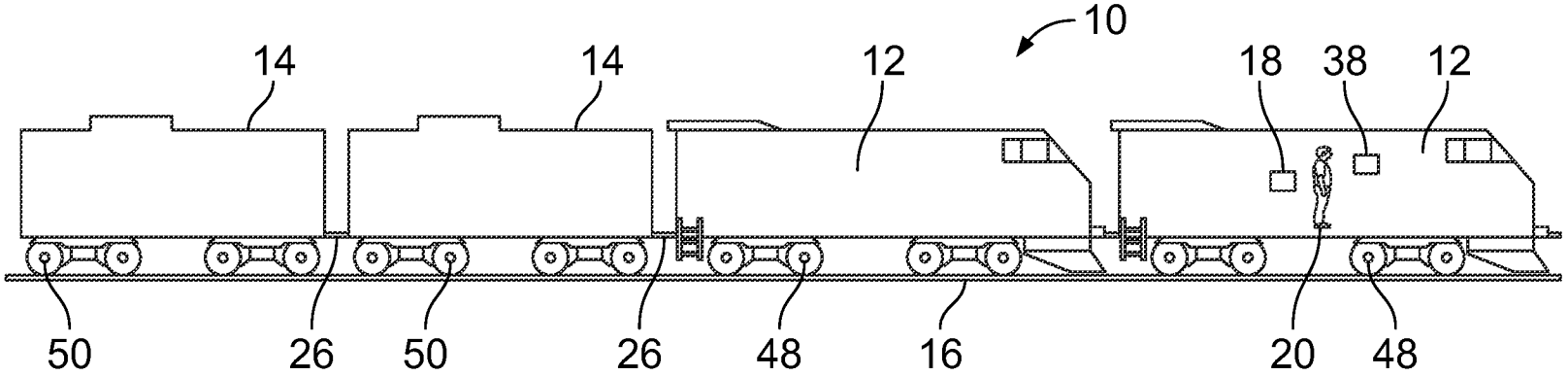
FIG. 2 schematically depicts a system for remotely operating a vehicle system according to one embodiment.
Figure 3:
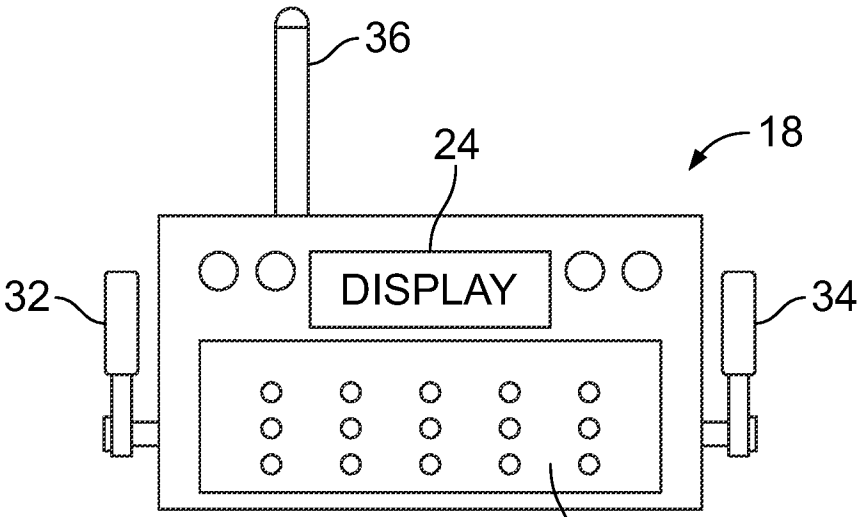
FIG. 3 schematically depicts a remote controller device according to one embodiment.

An operator 20 may remotely control operation of the vehicle system with a remote controller device, or operator control unit (OCU) 18. The remote controller device may send and receive signals 22 to and from one or more of the propulsion-generating vehicles. As shown in FIG. 1 the operator may be offboard the vehicle system while remotely controlling the vehicle system. As shown in FIG. 2, the operator may be onboard the vehicle system while remotely controlling the vehicle system. Referring to FIG. 3, the remote controller device includes a display 24 and an input interface 30 that allows the operator to input instructions to remotely control the one or more propulsion generating vehicles. The input interface may include switches or buttons or may be a keyboard or touch screen interface that accepts inputs from the operator. The remote controller device further includes a brake lever 32 and a throttle lever 34. The throttle lever may allow the operator to increase the speed of the vehicle system by adjusting the throttle lever from one discrete power setting, or notch, to another discrete power setting. The remote controller device includes an antenna 36 that sends the signals to the onboard controller device 38 onboard one or more of the propulsion-generating vehicles.

The propulsion-generating vehicle includes an independent braking system 42 that brakes wheels 48 of the propulsion-generating vehicle. The propulsion-generating vehicle also includes a dynamic braking system 40. The dynamic brake system can represent the traction motors operating in a regenerative braking mode in order to slow or stop movement of the vehicle. The vehicle system may further include an automatic braking system 44 for braking wheels 50 of the non-propulsion generating vehicles and the wheels of the propulsion-generating vehicle(s). The automatic braking system includes a brake pipe 46 that carries pressurized brake fluid (e.g., air) to activate the brakes for the wheels. The automatic brake system may be an Electronically Controlled Pneumatic (ECP) brake system that is controlled by the onboard controller device.

Sensors 52 may be provided on the one or more propulsion-generating vehicles and sensors 54 may be provided on the one or more non-propulsion-generating vehicles. The sensors may communicate by wire or wirelessly with the onboard controller device(s) of the one or more propulsion-generating vehicles. The sensors may provide visual data and sensor data. The sensors may include, but are not limited to, optical sensors such as digital video cameras, speed sensors, temperature sensors, oil pressure sensors, voltage sensors, current sensors, brake line pressure conveyed via end-of-train telemetry, operator input/output device status, and other locomotive sensors. Additional data that may be made available by sensors include, but not limited to, power notch setting, braking commands, and outputs of various engineer aids such as data produced by trip or rail network scheduling or optimizing systems. Other types of sensors that may provide data also include, but are not limited to, microphones, an accelerometer, digital thermometers, and location detection sensors, such as an on-board GPS system.

The remote controller device is configured to receive input from an operator, generate control signals based on the input, and to wirelessly communicate the control signals to the onboard controller device to control the movement of the vehicle system while the vehicle system moves along one or more routes, including one or more main line routes. As shown in FIG. 1, the remote controller device is configured to receive the input from the operator, generate the control signals, and wirelessly communicate the control signals while the remote controller device is offboard the vehicle system. As shown in FIG. 2, the remote controller device is configured to receive the input from the operator, generate the control signals, and wirelessly communicate the control signals while the remote controller device is onboard the vehicle system. The operator may be, or may not be, a certified or licensed locomotive operator.

The onboard controller device is configured to change a throttle setting of the propulsion system of the vehicle system to change the movement of the vehicle system based on the input that is received from the operator. The onboard controller device is configured to change a dynamic brake setting of the propulsion system of the vehicle system to change the movement of the vehicle system based on the input that is received from the operator. The onboard controller device is configured to change an independent brake setting of the brake system of the vehicle system to change the movement of the vehicle system based on the input that is received from the operator.

The remote controller device is configured to receive input from the operator of the remote controller device. According to one embodiment, one input may be a weight of the vehicle system and the remote controller device is configured to generate control signals based on the weight of the vehicle system. According to one embodiment, one input may be a grade on which the vehicle system is disposed and the remote controller device is configured to generate the control signals based on the grade.

According to one embodiment, the remote controller device is configured to receive one or more of a first number of propulsion-generating vehicles in the vehicle system or a second number of non-propulsion-generating vehicles in the vehicle system as the input from the operator and to generate the control signals based on the one or more of the first number or the second number. According to one embodiment, the vehicle system includes multiple propulsion-generating vehicles, and the onboard controller device is configured to synchronously control settings of one or more of the propulsion systems or the brake systems onboard the multiple propulsion-generating vehicles based on the control signals received from the remote controller device.

According to one embodiment, the remote controller device is configured to receive a speed set point as the input from the operator and to generate the control signals based on the speed set point.

According to one embodiment, the onboard controller device is configured to monitor inter-vehicle forces within the vehicle system, for example from sensors that determine forces on the couplers, and to control one or more of the propulsion system or the brake system based on the control signals received from the remote controller device to one or more of reduce the inter-vehicle forces or maintain the inter-vehicle forces within a designated range.

According to one embodiment, the onboard controller device is configured to restrict a frequency at which a throttle setting of the propulsion system is changed based on the control signals that are received from the remote controller device. According to one embodiment, the onboard controller device is configured to engage a dynamic brake of the brake system of the vehicle system responsive to the control signals received from the remote controller device directing the onboard controller device to stop the movement of the vehicle system.

The onboard controller device may include a proportional-integral-derivative (PID) controller and according to one embodiment the onboard controller device is configured to use a first set of control gains above a designated speed and a different, second set of control gains that change as a function of one or more operational parameters. The operational parameters include one or more of a weight of the vehicle system or a speed of the vehicle system.

According to one embodiment, the onboard controller device is configured to receive a current commanded speed that the vehicle system is to move. The onboard controller device is also configured to determine a current moving speed at which the vehicle system is moving and to calculate a reference shaped speed at which one or more of a propulsion system or a brake system of the vehicle system is directed to operate to cause the current moving speed of the vehicle system to approach the current commanded speed.

The reference speed determined by the onboard controller device is based on a reference shaping model that changes the reference speed based on relative values of the current commanded speed, a previous commanded speed that the vehicle system previously was commanded to move, the current moving speed of the vehicle system, and a previous reference shaped speed. The onboard controller device is configured to control the one or more of the propulsion system or the brake system to operate to cause the vehicle system to move at the reference shaped speed that is calculated.

According to one embodiment, the onboard controller device is configured to calculate the reference shaped speed by linearly increasing or linearly decreasing a previous value of the reference shaped speed.

According to one embodiment, the onboard controller device is configured to calculate the reference shaped speed by increasing or decreasing a previous value of the reference shaped speed at a rate that changes based on one or more of (a) a first difference between a current value of the reference shaped speed and the current commanded speed or (b) a second difference between the current moving speed of the vehicle system and one or more of the reference shaped speed or the current commanded speed. The onboard controller device is configured to calculate a faster value for the rate when the difference between the current value of the reference shaped speed and the current commanded speed is larger and a slower value when the difference between the current value of the reference shaped speed and the current commanded speed is smaller. The onboard controller device is configured to calculate a first designated value for the rate when the difference between the current value of the reference shaped speed and the current commanded speed is larger than a designated value and a second designated value for the rate that is slower than the first designated value when the difference between the current value of the reference shaped speed and the current commanded speed is no larger than the designated value.

According to one embodiment, the onboard controller device is configured to calculate the reference shaped speed by increasing or decreasing a previous value of the reference shaped speed at a first rate then a faster, second rate, followed by a slower, third rate.

According to one embodiment, the onboard controller device is configured to calculate the reference shaped speed by increasing or decreasing a previous value of the reference shaped speed according to a time invariant first order model.

According to one embodiment, the onboard controller device is configured to calculate the reference shaped speed by changing a previous value of the reference shaped speed according to a rate that is based on one or more of a weight of the vehicle system and the current moving speed.

According to one embodiment, the onboard controller device is configured to calculate a faster value for the rate when the difference between the current value of the reference shaped speed and the current commanded speed is larger and a slower value when the difference between the current value of the reference shaped speed and the current commanded speed is smaller.

According to one embodiment, the onboard controller device is configured to receive the current commanded speed from an operator input device, for example from the remote controller device.

According to one embodiment, the onboard controller device is configured to receive the current commanded speed from an automated control system.

Figure 4:
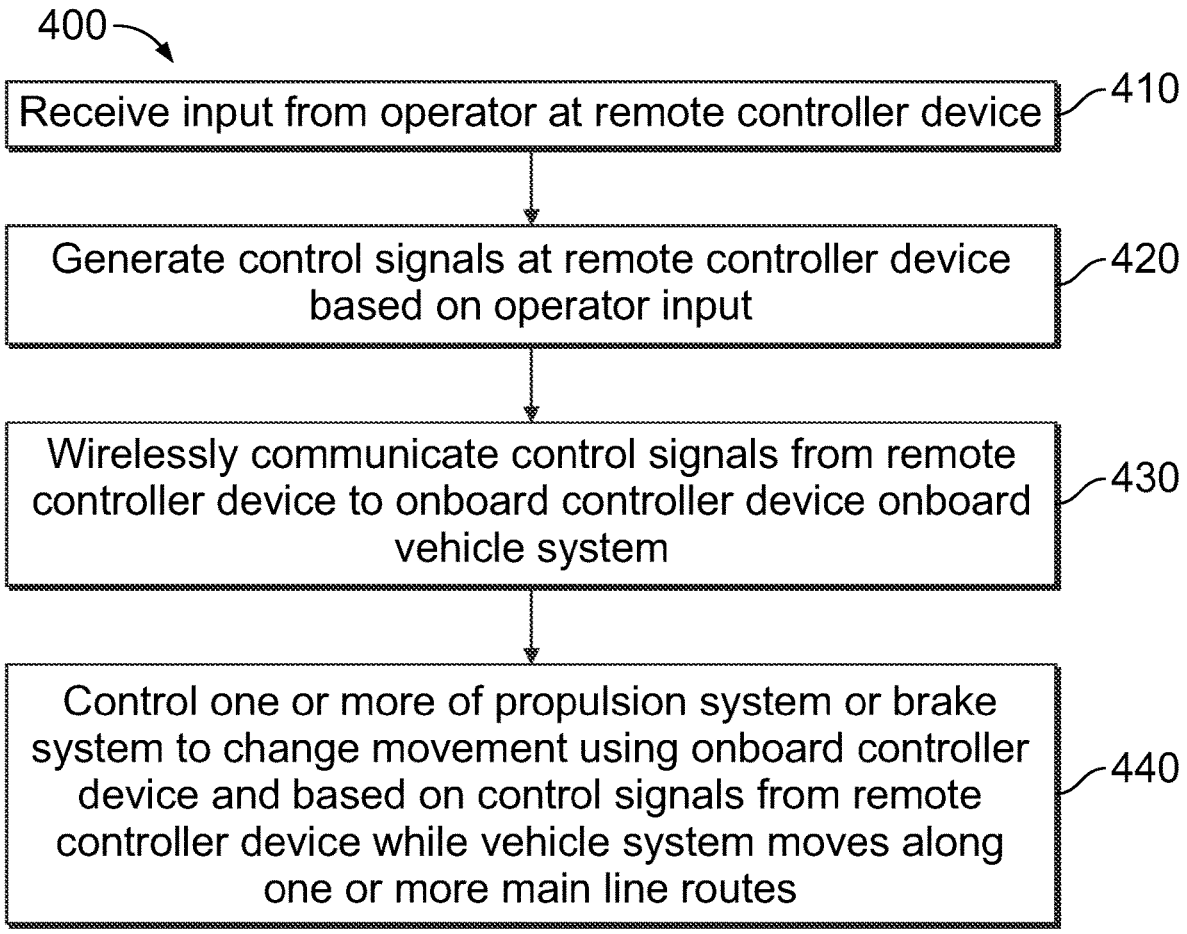
FIG. 4 schematically depicts a method according to one embodiment.

Referring to FIG. 4, a method 400 includes receiving input from an operator at a remote controller device of a vehicle control system 410 and generating control signals at the remote controller device based on the input from the operator 420. The method further includes wirelessly communicating the control signals from the remote controller device to an onboard controller device disposed onboard a vehicle system 430 and controlling one or more of a propulsion system or a brake system of the vehicle system to change movement of the vehicle system using the onboard controller device and based on the control signals that are received from the remote controller device while the vehicle system moves along one or more main line routes 440.

According to one embodiment, controlling the one or more of the propulsion system or the brake system includes changing a throttle setting of the propulsion system. Controlling the one or more of the propulsion system or the brake system may include changing a dynamic brake setting of the propulsion system. Controlling the one or more of the propulsion system or the brake system may include changing an independent brake setting of the brake system. Controlling the one or more of the propulsion system or the brake system may include controlling the movement of the vehicle system to move at speeds that exceed fifteen miles per hour.

According to one embodiment, receiving the input, generating the control signals, wirelessly communicating the control signals, and controlling the one or more of the propulsion system or the brake system occurs may occur while the remote controller device is offboard the vehicle system. According to one embodiment, receiving the input, generating the control signals, wirelessly communicating the control signals, and controlling the one or more of the propulsion system or the brake system occurs may occur while the remote controller device is onboard the vehicle system.

According to one embodiment, the vehicle system includes at least a first propulsion-generating vehicle that includes the propulsion system and a second non-propulsion-generating vehicle, and receiving the input, generating the control signals, wirelessly communicating the control signals, and controlling the one or more of the propulsion system or the brake system occurs while the remote controller device is onboard the non-propulsion-generating vehicle of the vehicle system.

According to one embodiment, the input that is received by the remote controller device includes one or more of a weight of the vehicle system, a grade on which the vehicle system is disposed, a first number of propulsion-generating vehicles in the vehicle system, a second number of non-propulsion-generating vehicles in the vehicle system, or a speed set point.

According to one embodiment, controlling the one or more of the propulsion system or the brake system includes adaptively limiting a frequency based on a controller mode at which a throttle setting of the propulsion system is changed based on the control signals that are received from the remote controller device.

According to one embodiment, the one or more of the propulsion system or the brake system includes engaging a dynamic brake of the brake system of the vehicle system responsive to the control signals received from the remote controller device directing the onboard controller device to stop the movement of the vehicle system.

Figure 5:
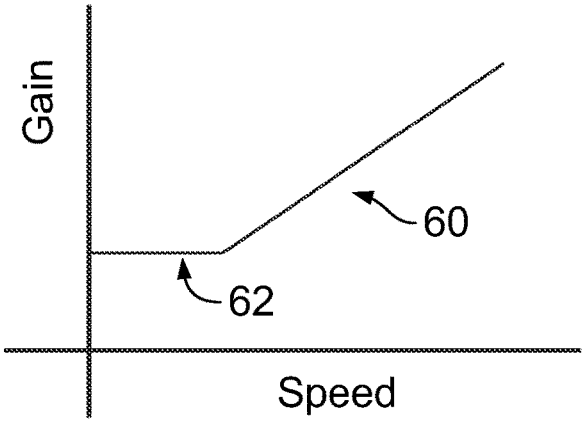
FIG. 5 schematically depicts a relationship between a gain of a closed loop control and a speed of the vehicle system.

According to one embodiment, controlling the one or more of the propulsion system or the brake system includes clamping a control gain that is output by a proportional-integral-derivative (PID) controller of the onboard controller device to the propulsion system of the vehicle system at speeds of the vehicle system that are slower than a designated speed limit. Referring to FIG. 5, the closed loop gain 60 is scheduled with respect to the mass of the vehicle system and the speed of the vehicle system. At low speeds, the gain value becomes too low. At low speeds the gain is kept at a threshold gain 62. By clamping the gain, undershoot and overshoot of the speed is reduced, on both ascending and descending grades.

Controlling the one or more of the propulsion system or the brake system may include transitioning from an open loop control mode to a closed loop control mode responsive to the vehicle system reaching the designated speed limit.

Figure 6:
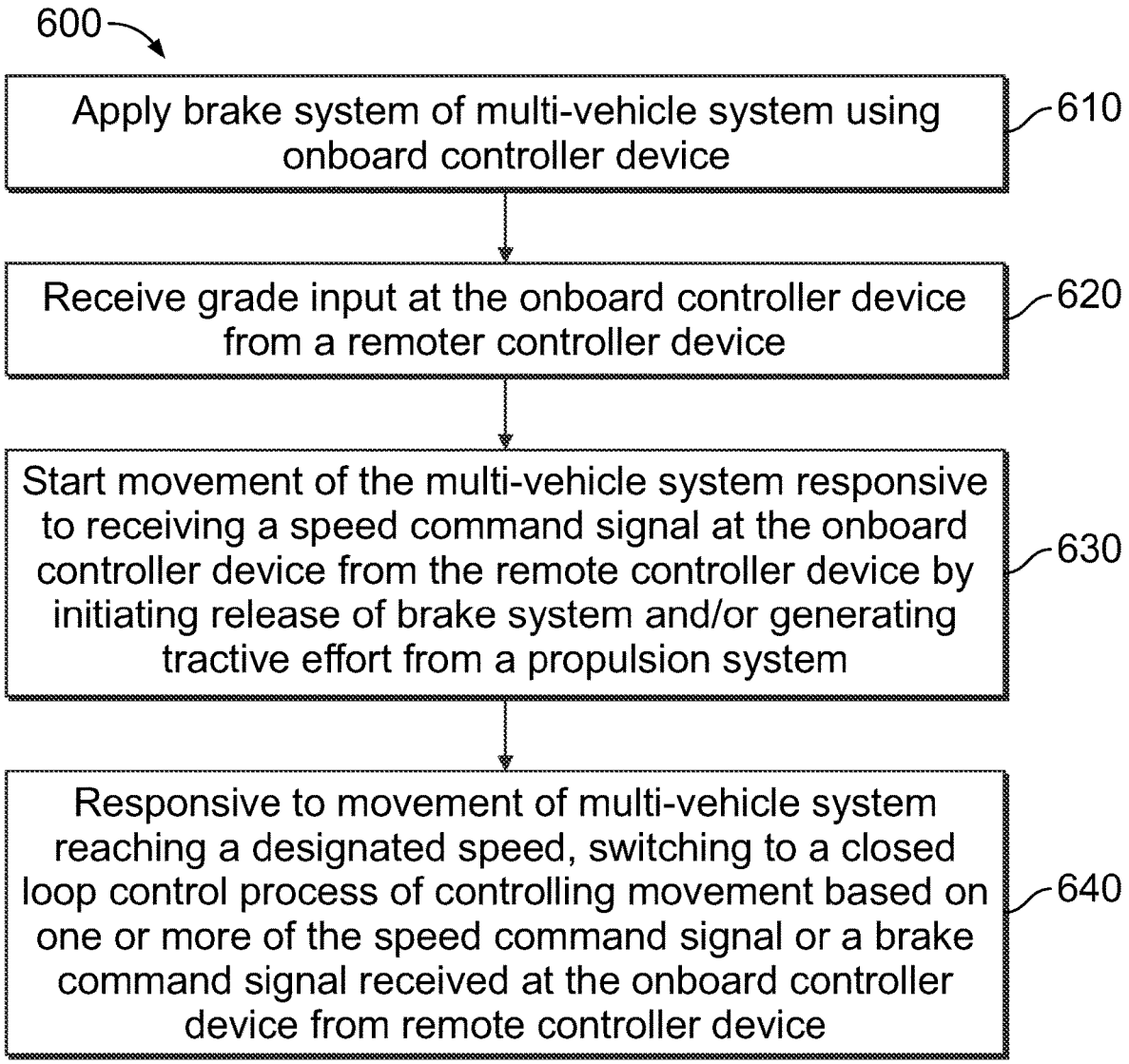
FIG. 6 schematically depicts a method according to one embodiment.

Referring to FIG. 6, a method 600 includes applying a brake system of a multi-vehicle system using an onboard controller device of the multi-vehicle system 610 and receiving grade input at the onboard controller device from a remote controller device 620. The grade input indicates a grade of a surface on which the multi-vehicle system is disposed. The method further includes starting movement of the multi-vehicle system responsive to receiving a speed command signal at the onboard controller device from the remote controller device 630. The movement of the multi-vehicle system is started by initiating release of the brake system and/or generating tractive effort from a propulsion system of the multi-vehicle system. Starting the movement of the multi-vehicle system stretches the multi-vehicle system. The method further includes, responsive to the movement of the multi-vehicle system reaching a designated speed, switching to a closed loop control process of controlling the movement of the multi-vehicle system based on one or more of the speed command signal or a brake command signal received at the onboard controller device from the remote controller device 640.

According to one embodiment, the grade input that is received at the onboard controller device indicates that the multi-vehicle system is on an ascending grade, and the method further includes maintaining application of the brake system while concurrently increasing the tractive effort that is generated by the propulsion system and determining whether the multi-vehicle system is rolling backward down the ascending grade. Responsive to determining that the multi-vehicle system is not rolling backward down the ascending grade, the method further includes releasing the brake system while continuing to generate the tractive effort at a first threshold level. Responsive to determining that the multi-vehicle system is rolling backward down the ascending grade, the method further includes maintaining application of the brake system while concurrently generating the tractive effort at a second threshold level that is greater than the first threshold level.

According to one embodiment, the grade input that is received at the onboard controller device indicates that the multi-vehicle system is on a flat grade, and the method further includes releasing the brake system at a configurable slew rate and concurrently generating the tractive effort with the propulsion system until the multi-vehicle system is stretched or the multi-vehicle system is moving forward.

According to one embodiment, the grade input that is received at the onboard controller device indicates that the multi-vehicle system is on a descending grade, and the method further includes verifying that one or more traction motors of the propulsion system are set up for dynamic braking, releasing the brake system at a configurable slew rate, and determining whether the multi-vehicle system is moving forward. Responsive to determining that the multi-vehicle system is moving forward, the method further includes engaging the one or more traction motors to dynamically brake to keep a moving speed of the multi-vehicle system to be no faster than the designated speed.

According to one embodiment, the method further includes determining that the multi-vehicle system is rolling backward in contradiction to the grade input that was received and engaging the brake system to stop the multi-vehicle system from rolling backward. The method further includes building up generation of the tractive effort provided by the propulsion system while concurrently engaging the brake system until the multi-vehicle system no longer rolls backward and releasing the brake system.

According to one embodiment, the closed loop control process of controlling the movement of the multi-vehicle system includes maintaining a speed of the multi-vehicle system at or within a threshold range of the speed command signal by alternating between (a) dynamically braking the multi-vehicle system using the propulsion system of the multi-vehicle system and (b) setting a throttle of the propulsion system to idle while the speed of the multi-vehicle system exceeds a designated stall speed of the multi-vehicle system to maintain the movement of the multi-vehicle. The method further includes applying the brake system of the multi-vehicle system responsive to (c) receiving an updated speed command signal at the onboard controller device from the remote controller device that reduces the speed of the multi-vehicle system and (d) the speed of the multi-vehicle system reaching the stall speed.

According to one embodiment, the brake system of the multi-vehicle system includes independent brakes, and the closed loop control process of controlling the movement of the multi-vehicle system includes maintaining a speed of the multi-vehicle system at or within a threshold range of the speed command signal by alternating between (a) applying the independent brakes of the multi-vehicle system and (b) setting a throttle of the propulsion system to idle while the speed of the multi-vehicle system exceeds a designated stall speed of the multi-vehicle system to maintain the movement of the multi-vehicle. The method further includes applying the independent brakes of the multi-vehicle system responsive to (c) receiving an updated speed command signal at the onboard controller device from the remote controller device that reduces the speed of the multi-vehicle system and (d) the speed of the multi-vehicle system reaching the stall speed.

Figure 7:
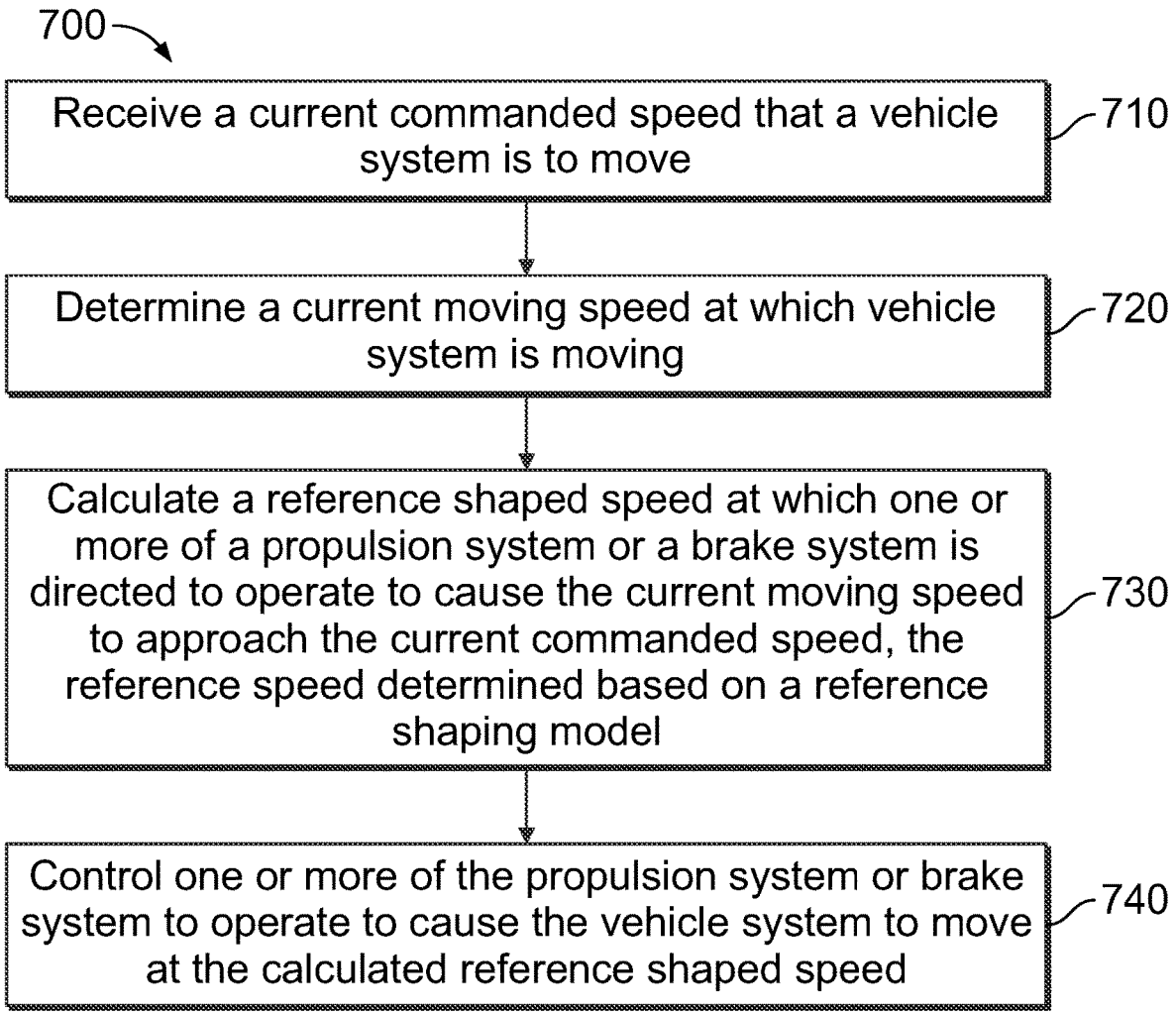
FIG. 7 schematically depicts a method according to one embodiment.
Figure 8:
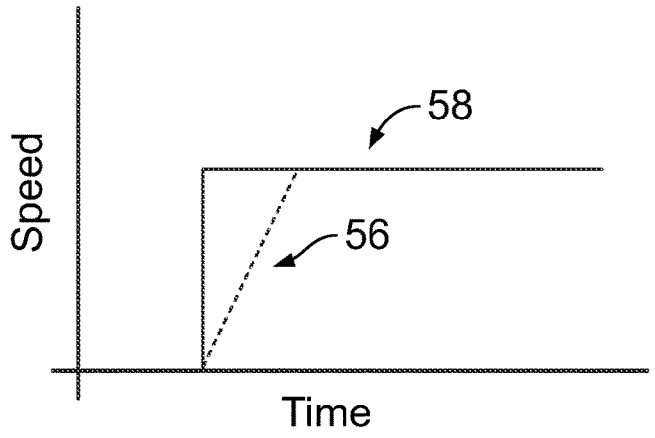
FIG. 8 schematically depicts a relationship between a current commanded speed of the vehicle system and a reference shaped speed.

Referring to FIG. 7, a method 700 includes receiving a current commanded speed that a vehicle system is to move 710 and determining a current moving speed at which the vehicle system is moving 720. To reduce undershoot and overshoot, the current commanded speed may be increased and decreased gradually at a configurable slew rate of the onboard controller device. The method further includes calculating a reference shaped speed at which one or more of a propulsion system or a brake system of the vehicle system is directed to operate to cause the current moving speed of the vehicle system to approach the current commanded speed 730. Referring to FIG. 8, the reference shaped speed 56 is calculated to approach the current commanded speed 58. The reference speed is determined based on a reference shaping model that changes the reference speed based on relative values of the current commanded speed, a previous commanded speed that the vehicle system previously was commanded to move, and the current moving speed of the vehicle system. Referring again to FIG. 7, the method further includes controlling the one or more of the propulsion system or the brake system to operate to cause the vehicle system to move at the reference shaped speed that is calculated 740.

According to one embodiment, the reference shaped speed is calculated by linearly increasing or linearly decreasing a previous value of the reference shaped speed.

According to one embodiment, the reference shaped speed is calculated by increasing or decreasing a previous value of the reference shaped speed at a rate that changes based on a difference between a current value of the reference shaped speed and the current commanded speed. The rate is faster when the difference between the current value of the reference shaped speed and the current commanded speed is larger and the rate is slower when the difference between the current value of the reference shaped speed and the current commanded speed is smaller. The rate is a first designated rate when the difference between the current value of the reference shaped speed and the current commanded speed is larger than a designated value and the rate is a second designated rate that is slower than the first designated rate when the difference between the current value of the reference shaped speed and the current commanded speed is no larger than the designated value.

According to one embodiment, the reference shaped speed is calculated by increasing or decreasing a previous value of the reference shaped speed according to a time invariant first order model. According to one embodiment, the reference shaped speed is calculated by changing a previous value of the reference shaped speed at a rate that changes based on one or more of a weight of the vehicle system and the current moving speed. According to one embodiment, the current commanded speed is received from an operator input device, for example from the remote controller device or the onboard controller device. According to one embodiment, the current commanded speed is received from an automated control system.

A vehicle control system may include an onboard controller device configured to be onboard a vehicle system and to interface with a propulsion system and a brake system of the vehicle system to change movement of the vehicle system and a remote controller device configured to wirelessly communicate with the onboard controller device. The remote controller device may be configured to receive input from an operator, generate control signals based on the input, and to wirelessly communicate the control signals to the onboard controller device to control the movement of the vehicle system while the vehicle system moves along one or more main line routes.

Optionally, the onboard controller device may be configured to change a throttle setting of the propulsion system of the vehicle system to change the movement of the vehicle system based on the input that is received from the operator. Optionally, the onboard controller device may be configured to change a dynamic brake setting of the propulsion system of the vehicle system to change the movement of the vehicle system based on the input that is received from the operator.

Optionally, the onboard controller device may be configured to change an independent brake setting of the brake system of the vehicle system to change the movement of the vehicle system based on the input that is received from the operator.

Optionally, the onboard controller device may be configured to control the movement of the vehicle system along mainline routes. Optionally, the remote controller device and the onboard controller device may be configured to control the movement of the vehicle system that is sized to hold one or more human passengers.

Optionally, the remote controller device may be configured to receive the input from the operator, generate the control signals, and wirelessly communicate the control signals while the remote controller device is offboard the vehicle system. Optionally, the remote controller device may be configured to receive the input from the operator, generate the control signals, and wirelessly communicate the control signals while the remote controller device is onboard the vehicle system.

Optionally, the vehicle system may include at least a first propulsion-generating vehicle that includes the propulsion system and a second non-propulsion-generating vehicle, and the remote controller device may be configured to receive the input from the operator, generate the control signals, and wirelessly communicate the control signals while the remote controller device is onboard the non-propulsion-generating vehicle of the vehicle system. Optionally, the remote controller device may be configured to receive the input from the operator that is not a certified or licensed locomotive operator and to generate the control signals based on the input for controlling the movement of the vehicle system.

Optionally, the remote controller device may be configured to receive a weight of the vehicle system as the input from the operator and to generate the control signals based on the weight of the vehicle system. Optionally, the remote controller device may be configured to receive a grade on which the vehicle system is disposed as the input from the operator and to generate the control signals based on the grade.

Optionally, the remote controller device may be configured to receive one or more of a first number of propulsion-generating vehicles in the vehicle system or a second number of non-propulsion-generating vehicles in the vehicle system as the input from the operator and to generate the control signals based on the one or more of the first number or the second number. Optionally, the remote controller device may be configured to receive a speed set point as the input from the operator and to generate the control signals based on the speed set point.

Optionally, the vehicle system may include multiple propulsion-generating vehicles, and the onboard controller device may be configured to synchronously control settings of one or more of the propulsion system or the brake system onboard the multiple propulsion-generating vehicles based on the control signals received from the remote controller device.

Optionally, the vehicle system may include multiple propulsion-generating vehicles, and the onboard controller device may be configured to asynchronously control settings of one or more of the propulsion system or the brake system onboard the multiple propulsion-generating vehicles based on the control signals received from the remote controller device.

Optionally, the vehicle system may include multiple vehicles and the onboard controller device may be configured to monitor inter-vehicle forces within the vehicle system and to control one or more of the propulsion system or the brake system based on the control signals received from the remote controller device to one or more of reduce the inter-vehicle forces or maintain the inter-vehicle forces within a designated range.

Optionally, the onboard controller device may be configured to restrict a frequency at which a throttle setting of the propulsion system is changed based on the control signals that are received from the remote controller device.

Optionally, the onboard controller device may be configured to engage a dynamic brake of the brake system of the vehicle system responsive to the control signals received from the remote controller device directing the onboard controller device to stop the movement of the vehicle system.

Optionally, the onboard controller device may include a proportional-integral-derivative (PID) controller and the onboard controller device may be configured to use a first set of control gains above a designated speed and a different, second set of control gains that change as a function of one or more operational parameters. Optionally, the operational parameters may include one or more of a weight of the vehicle system or a speed of the vehicle system.

A method may include receiving input from an operator at a remote controller device of a vehicle control system and generating control signals at the remote controller device based on the input from the operator. The method may further include wirelessly communicating the control signals from the remote controller device to an onboard controller device disposed onboard a vehicle system and controlling one or more of a propulsion system or a brake system of the vehicle system to change movement of the vehicle system using the onboard controller device and based on the control signals that are received from the remote controller device while the vehicle system moves along one or more main line routes.

Optionally, controlling the one or more of the propulsion system or the brake system may include changing a throttle setting of the propulsion system.

Optionally, controlling the one or more of the propulsion system or the brake system may include changing a dynamic brake setting of the propulsion system. Optionally, controlling the one or more of the propulsion system or the brake system may include changing an independent brake setting of the brake system. Optionally, controlling the one or more of the propulsion system or the brake system may include controlling the movement of the vehicle system to move at speeds that exceed fifteen miles per hour.

Optionally, receiving the input, generating the control signals, wirelessly communicating the control signals, and controlling the one or more of the propulsion system or the brake system may occur while the remote controller device is offboard the vehicle system. Optionally, receiving the input, generating the control signals, wirelessly communicating the control signals, and controlling the one or more of the propulsion system or the brake system may occur while the remote controller device is onboard the vehicle system.

Optionally, the vehicle system may include at least a first propulsion-generating vehicle that includes the propulsion system and a second non-propulsion-generating vehicle, and receiving the input, generating the control signals, wirelessly communicating the control signals, and controlling the one or more of the propulsion system or the brake system may occur while the remote controller device is onboard the non-propulsion-generating vehicle of the vehicle system.

Optionally, the input may be received by the remote controller device from the operator that is not a certified or licensed train engineer.

Optionally, the input that may be received by the remote controller device includes one or more of a weight of the vehicle system, a grade on which the vehicle system is disposed, a first number of propulsion-generating vehicles in the vehicle system, a second number of non-propulsion-generating vehicles in the vehicle system, or a speed set point.

Optionally, the vehicle system may include multiple propulsion-generating vehicles and controlling the one or more of the propulsion system or the brake system may include synchronously controlling settings of the one or more of the propulsion system or the brake system onboard the multiple propulsion-generating vehicles based on the control signals received from the remote controller device.

Optionally, the vehicle system may include multiple vehicles, and the method may further include monitoring inter-vehicle forces within the vehicle system and controlling one or more of the propulsion system or the brake system based on the control signals received from the remote controller device to one or more of reduce the inter-vehicle forces or maintain the inter-vehicle forces within a designated range.

Optionally, controlling the one or more of the propulsion system or the brake system may include adaptively limiting a frequency based on a controller mode at which a throttle setting of the propulsion system is changed based on the control signals that are received from the remote controller device.

Optionally, controlling the one or more of the propulsion system or the brake system may include engaging a dynamic brake of the brake system of the vehicle system responsive to the control signals received from the remote controller device directing the onboard controller device to stop the movement of the vehicle system.

Optionally, controlling the one or more of the propulsion system or the brake system may include clamping a control gain that is output by a proportional-integral-derivative (PID) controller to the propulsion system of the vehicle system at speeds of the vehicle system that are slower than a designated speed limit.

Optionally, controlling the one or more of the propulsion system or the brake system includes transitioning from an open loop control mode to a closed loop control mode responsive to the vehicle system reaching the designated speed limit.

A vehicle control system may include an onboard controller device configured to be onboard a vehicle system and to interface with a propulsion system and a brake system of the vehicle system to change movement of the vehicle system and a remote controller device configured to wirelessly communicate with the onboard controller device. The remote controller device may be configured to receive input from an operator, generate control signals based on the input, and to wirelessly communicate the control signals to the onboard controller device to control the movement of the vehicle system while the vehicle system moves along one or more main line routes. The control signals may direct changes in one or more of dynamic braking or independent brakes of the brake system of the vehicle system.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A vehicle control system comprising:

a remote controller device disposed offboard a vehicle system and configured to wirelessly communicate with an onboard controller device, the remote controller device configured to:

receive input from an operator, wherein the input comprises one or more of (a) a weight of the vehicle system, (b) a grade on which the vehicle system is disposed, or (c) one or more of a first number of propulsion-generating vehicles in the vehicle system or a second number of non-propulsion-generating vehicles;

generate control signals based on one or more of (a) the weight, (b) the grade, or (c) one or more of the first number of propulsion-generating vehicles or the second number of non-propulsion-generating vehicles in the vehicle system; and wirelessly communicate the control signals to the onboard controller device to control a movement of a vehicle system to move the vehicle system along one or more main line routes; and the onboard controller device configured to be onboard the vehicle system and to interface with a propulsion system and a brake system of the vehicle system, the onboard controller device configured to determine inter-vehicle forces on mechanical couplers between a plurality of vehicles within the vehicle system and to control one or more of the propulsion system or the brake system based on the control signals received from the remote controller device to one or more of reduce the inter-vehicle forces on the mechanical couplers or maintain the inter-vehicle forces on the mechanical couplers within a designated range.

2. The vehicle control system of claim 1, wherein the onboard controller device is configured to change one or more of (a) throttle setting of the propulsion system of the vehicle system to change the movement of the vehicle system, (b) a dynamic brake setting of the propulsion system of the vehicle system to change the movement of the vehicle system, (c) an independent brake setting of the brake system of the vehicle system to change the movement of the vehicle system, based on the input that is received from the operator.

3. The vehicle control system of claim 1, wherein the remote controller device and the onboard controller device are configured to control the movement of the vehicle system that is sized to hold one or more human passengers.

4. The vehicle control system of claim 1, wherein the remote controller device is configured to receive the input from the operator that is not a certified or licensed locomotive operator and to generate the control signals based on the input for controlling the movement of the vehicle system.

5. The vehicle control system of claim 1, wherein the vehicle system includes multiple propulsion-generating vehicles, and the onboard controller device is configured to asynchronously control settings of one or more of the propulsion system or the brake system onboard the multiple propulsion-generating vehicles based on the control signals received from the remote controller device.

6. The vehicle control system of claim 1, wherein the onboard controller device is configured to restrict a frequency at which a throttle setting of the propulsion system is changed based on the control signals that are received from the remote controller device.

7. The vehicle control system of claim 1, wherein the onboard controller device is configured to engage a dynamic brake of the brake system of the vehicle system responsive to the control signals received from the remote controller device directing the onboard controller device to stop the movement of the vehicle system.

8. The vehicle control system of claim 1, wherein the onboard controller device includes a proportional-integral-derivative (PID) controller and the onboard controller device is configured to use a first set of control gains above a designated speed and a different, second set of control gains that change as a function of one or more operational parameters, wherein the one or more operational parameters include one or more of a weight of the vehicle system or a speed of the vehicle system.

9. A method comprising:

receiving input from an operator at a remote controller device of a vehicle control system, wherein the input comprises one or more of (a) a weight of a vehicle system, (b) a grade on which the vehicle system is disposed, or (c) one or more of a first number of propulsion-generating vehicles or a second number of non-propulsion-generating vehicles in the vehicle system;

generating control signals at the remote controller device based on one or more of (a) the weight, (b) the grade, or (c) the one or more of the first number of propulsion-generating vehicles or the second number of non-propulsion-generating vehicles in the vehicle system;

monitoring inter-vehicle forces on mechanical couplers between vehicles within the vehicle system;

wirelessly communicating the control signals from the remote controller device, while the remote controller device is off board the vehicle system, to an onboard controller device; and controlling one or more of a propulsion system or a brake system of the vehicle system to change movement of the vehicle system to move the vehicle system along one or more main line routes using the onboard controller device and based on the control signals that are received from the remote controller device to one or more of reduce the inter-vehicle forces on the mechanical couplers or maintain the inter-vehicle forces on the mechanical couplers within a designated range.

10. The method of claim 9, wherein controlling the one or more of the propulsion system or the brake system includes changing one or more of (a) a throttle setting of the propulsion system or (b) a dynamic brake setting of the propulsion system or (c) an independent brake setting of the brake system to control the movement of the vehicle system to move at speeds that exceed fifteen miles per hour.

11. The method of claim 9, wherein the vehicle system includes multiple propulsion-generating vehicles, and controlling the one or more of the propulsion system or the brake system includes asynchronously controlling settings of the one or more of the propulsion system or the brake system onboard the multiple propulsion-generating vehicles based on the control signals received from the remote controller device.

12. The method of claim 9, wherein controlling the one or more of the propulsion system or the brake system includes clamping a control gain that is output by a proportional-integral-derivative (PID) controller to the propulsion system of the vehicle system at speeds of the vehicle system that are slower than a designated speed limit, wherein controlling the one or more of the propulsion system or the brake system includes transitioning from an open loop control mode to a closed loop control mode responsive to the vehicle system reaching the designated speed limit.

13. A vehicle control system comprising:

a remote controller device disposed off board a vehicle system and configured to wirelessly communicate with an onboard controller device, the remote controller device configured to:

receive input from an operator, wherein the input is one or more of (a) a weight of the vehicle system, (b) a grade on which the vehicle system is disposed, or (c) one or more of a first number of propulsion-generating vehicles or a second number of non-propulsion-generating vehicles in the vehicle system;

generate control signals based on one or more of (a) the weight, (b) the grade, or (c) the one or more of the first number of propulsion-generating vehicles or the second number of non-propulsion-generating vehicles in the vehicle system; and wirelessly communicate the control signals to the onboard controller device to control a movement of a vehicle system to move the vehicle system along one or more main line routes, the control signals directing changes in one or more of dynamic braking or independent brakes of the brake system of the vehicle system; and the onboard controller device configured to be onboard the vehicle system and to interface with a propulsion system and a brake system of the vehicle system, the onboard controller configured to determine inter-vehicle forces on mechanical couplers between a plurality of vehicles within the vehicle system and to control one or more of the propulsion system or the brake system based on the control signals received from the remote controller device to one or more of reduce the inter-vehicle forces on the mechanical couplers or maintain the inter-vehicle forces on the mechanical couplers within a designated range.

14. The vehicle system of claim 1, wherein the remote controller device is further configured to:

receive a set speed of the vehicle system;

determine a moving speed of the vehicle system;

determine a reference speed based on the set speed and the moving speed, the reference speed to reduce an undershoot or overshoot of the set speed; and wirelessly communicate the control signals to the onboard controller device to control the movement of the vehicle system to move the vehicle system at the reference speed along the one or more main line routes.

15. The method of claim 9, further comprising:

receiving a set speed of the vehicle system;

determining a moving speed of the vehicle system;

determining a reference speed based on the set speed and the moving speed, the reference speed to reduce an undershoot or overshoot of the set speed; and wirelessly communicating the control signals to the onboard controller device to control the movement of the vehicle system to move the vehicle system at the reference speed along the one or more main line routes.

* * * * *